US009160082B2

(12) United States Patent
Heringhaus et al.

(10) Patent No.: US 9,160,082 B2
(45) Date of Patent: Oct. 13, 2015

(54) SLEEVE CONTACT FOR AN ELECTRICAL ZERO-FORCE PLUG-TYPE CONNECTOR

(71) Applicant: Kostal Kontakt Systeme GmbH, Luedenscheid (DE)

(72) Inventors: Wilfried Heringhaus, Herne (DE); Herbert Plate, Luedenscheid (DE); Patrick Heinemann, Hagen (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 14/334,023

(22) Filed: Jul. 17, 2014

(65) Prior Publication Data

US 2014/0329419 A1 Nov. 6, 2014

Related U.S. Application Data

(63) Continuation-in-part of application No. PCT/EP2013/052056, filed on Feb. 1, 2013.

(30) Foreign Application Priority Data

Feb. 4, 2012 (DE) ..... 10 2012 002 145

(51) Int. Cl.
*H01R 13/187* (2006.01)
*H01R 4/48* (2006.01)
(Continued)

(52) U.S. Cl.
CPC ..... *H01R 4/4854* (2013.01); *H01R 13/187* (2013.01); *H01R 13/193* (2013.01); *H01R 4/185* (2013.01)

(58) Field of Classification Search
CPC ... H01R 13/187; H01R 13/111; H01R 13/113
See application file for complete search history.

(56) References Cited

U.S. PATENT DOCUMENTS 1,696,616 A * 12/1928 Wappler ..... 439/844
4,118,093 A 10/1978 Obeissart
(Continued)

FOREIGN PATENT DOCUMENTS

DE 1113493 B 9/1961
DE 102004015344 A1 10/2005
(Continued)

OTHER PUBLICATIONS

European Patent Office, International Search Report for the corresponding International Application No. PCT/EP2013/052056 mailed May 23, 2013.
(Continued)

*Primary Examiner* — Gary Paumen
(74) *Attorney, Agent, or Firm* — Brooks Kushman P.C.

(57) ABSTRACT

A sleeve contact includes a base body, a clamping sleeve, and a spring. The base body includes a receiving region. The clamping sleeve displaceable against the base body. The spring has first and second S-curve sections and is mounted at one end to the base body to thereby form a lever having a short lever arm from the end to the first S-curve section and a long lever arm from the end to the second S-curve section. The clamping sleeve acts on the spring as the contact sleeve displaces to produce a contact force towards the receiving region such that the long lever arm is pressed by the clamping sleeve towards the receiving region to thereby cause the short lever arm to bear against a plug contact inserted into the receiving region.

14 Claims, 3 Drawing Sheets

(51) Int. Cl.
*H01R 13/193* (2006.01)
*H01R 4/18* (2006.01)

(56) References Cited

U.S. PATENT DOCUMENTS

| | | | | |
|---|---|---|---|---|
| 4,934,964 | A * | 6/1990 | Mazelle | 439/843 |
| 4,950,183 | A * | 8/1990 | Watanabe et al. | 439/843 |
| 5,147,230 | A * | 9/1992 | Plyler et al. | 439/843 |
| 5,730,628 | A * | 3/1998 | Hawkins | 439/843 |
| 6,050,862 | A | 4/2000 | Ishii | |
| 6,062,918 | A * | 5/2000 | Myer et al. | 439/839 |
| 6,196,884 | B1 * | 3/2001 | Tanaka | 439/847 |
| 7,118,428 | B2 * | 10/2006 | Gamaggio et al. | 439/843 |
| 7,232,323 | B2 | 6/2007 | Mohs et al. | |
| 7,291,030 | B2 | 11/2007 | Mohs | |
| 7,294,027 | B1 | 11/2007 | Tyler | |
| 7,381,104 | B2 | 6/2008 | Rehbein et al. | |
| 7,387,548 | B2 * | 6/2008 | Takehara et al. | 439/843 |
| 7,789,720 | B2 * | 9/2010 | Zinn | 439/845 |
| 8,827,754 | B2 * | 9/2014 | Lee et al. | 439/845 |
| 2005/0233651 | A1 * | 10/2005 | Gamaggio et al. | 439/843 |
| 2007/0049088 | A1 | 3/2007 | Mohs et al. | |
| 2007/0099508 | A1 | 5/2007 | Mohs | |
| 2007/0218763 | A1 | 9/2007 | Rehbein et al. | |
| 2008/0146091 | A1 * | 6/2008 | Tyler | 439/843 |
| 2011/0086557 | A1 | 4/2011 | Kubota | |

FOREIGN PATENT DOCUMENTS

| | | | |
|---|---|---|---|
| DE | 102006009074 | A1 | 8/2007 |
| DE | 102006013347 | A1 | 9/2007 |
| DE | 102008012925 | A1 | 9/2009 |
| EP | 1760837 | A1 | 3/2007 |
| EP | 1764874 | A2 | 3/2007 |
| WO | 2008042071 | A2 | 4/2008 |

OTHER PUBLICATIONS

German Patent Office, Search Report for the corresponding German Patent Application No. 10 2012 002 145.3 mailed Sep. 9, 2012.

* cited by examiner (Background)

(Background)

SLEEVE CONTACT FOR AN ELECTRICAL ZERO-FORCE PLUG-TYPE CONNECTOR

CROSS-REFERENCE TO RELATED APPLICATIONS

This application is a continuation-in-part of International Application No. PCT/EP2013/052056, published in German, with an International filing date of Feb. 1, 2013, which claims priority to DE 10 2012 002 145.3, filed Feb. 4, 2012; the disclosures of which are hereby incorporated in their entirety by reference herein.

TECHNICAL FIELD

The present invention relates to a sleeve contact for an electrical zero force plug type connector, the sleeve contact having a base body and a clamping sleeve in which the base body has a receiving region for receiving a plug contact, the clamping sleeve is displaceable on the base body between opened and closed sliding positions, and in the closed sliding position the clamping sleeve produces a contacting force on the receiving region of the sleeve contact to contact and secure a plug contact inserted into the receiving region.

BACKGROUND

A plug-in connector such as those used in modern devices, and in particular in the automotive area, for contacting control units or for connecting electrical/electronic assemblies integrated into the instrument panel to the onboard power supply, often have a large number of terminals due to the increasing complexity of such assemblies. The force required for joining conventional multi-terminal connector parts is not insignificant. The reason for this is that according to regulations a relatively high contacting force is to be applied respectively to each plug contact inserted into a sleeve contact to assure a secure contact, even under most varied environmental conditions. These contacting forces increase according to the number of contacts to be connected. In order to simplify the connection of multi-terminal plug type connectors, so-called zero force plug type connectors have been developed that can be joined with only a small force and the contacting forces are applied only at the end of the joining path.

DE 10 2004 015 344 A1 (corresponding to U.S. Pat. No. 7,291,030) describes a zero force plug type connector in which sleeve contacts are joined in a force-free manner with pin-shaped mating contacts of a second plug type connector. Only in the final joining phase of the two plug type connectors does an actuating element apply contacting force to the plug contact receiving region of a sleeve contact by sliding an adjusting plate.

EP 1 760 837 B1 (corresponding to U.S. Pat. No. 7,232,323) describes, among other things, a sleeve contact as part of an electrical zero force plug type connector. The sleeve contact has contacting blades formed as part of a base body.

This background art with respect to sleeve contacts is shown in FIGS. 3 and 4 herein and is described herein in greater detail in the description of these figures.

With respect to the background art sleeve contacts, a clamping sleeve displaceable relative to the base body enables a pin-shaped plug contact to be inserted with essentially zero force into an opening of the base body when the clamping sleeve is in a first (opened) sliding position. The plug contact can be round or flat. When in a second (closed) sliding position, the clamping sleeve presses contact points and/or contacting blades of the base body against the plug contact inserted into the opening of the base body and thus produces the contacting force required to achieve a good electrical connection between the plug contact and the sleeve contact. The strength of the contacting force that can be obtained in this manner is essentially determined and limited by properties like the type of material, strength of material, and shape of the base body.

SUMMARY

An object of the present invention is to create a simple and cost-effective electrical sleeve contact that can produce an especially high contact force.

In carrying out at least one of the above and other objects, the present invention provides a sleeve contact. The sleeve contact includes a base body, a clamping sleeve, and a spring. The base body includes a receiving region. The clamping sleeve displaceable against the base body. The spring has first and second S-curve sections and is mounted at one end to the base body to thereby form a lever having a short lever arm from the end to the first S-curve section and a long lever arm from the end to the second S-curve section. The clamping sleeve acts on the spring as the contact sleeve displaces to produce a contact force towards the receiving region such that the long lever arm is pressed by the clamping sleeve towards the receiving region to thereby cause the short lever arm to bear against a plug contact inserted into the receiving region.

Further, in carrying out at least one of the above and other objects, the present invention provides a sleeve contact for an electrical zero force plug type connector. The sleeve contact includes a base body, a clamping sleeve, and a spring. The base body has a receiving region to receive a plug contact therein. The clamping sleeve has a bulge. The clamping sleeve is displaceable against the base body between an opened position and a closed position. While in the opened position the clamping sleeve enables a plug contact to be inserted into or removed from the receiving region. The spring has a S-shaped profile including a first S-curve section and a second S-curve section and is mounted at one end to the base body to thereby form a lever having a short lever arm from the end to the first S-curve section and a long lever arm from the end to the second S-curve section. The clamping sleeve acts on the spring as the clamping sleeve displaces against the base body between the opened and closed positions. While in the closed position the clamping sleeve produces a contact force towards the receiving region such that the long lever arm is pressed by the bulge of the clamping sleeve radially inwards towards the receiving region to thereby cause the short lever arm to bear against a plug contact inserted into the receiving region in order to securely contact the plug contact inserted into the receiving region.

Embodiments of the present invention are directed to a sleeve contact for an electrical zero-force plug-type connector in which the sleeve contact includes a base body and a clamping sleeve. The base body has a receiving region for receiving a plug-type contact therein. The clamping sleeve is movably or slidably arranged on the base body to be displaceable relative to the base body between opened and closed sliding positions. A plug contact may be inserted into or removed from the receiving region of the base body (i.e., the receiving region of the sleeve contact) with relatively zero-force while the clamping sleeve is in the opened sliding position. The clamping sleeve produces a contact force towards the receiving region of the sleeve contact when the clamping sleeve is in the closed sliding position in order to make contact with a plug contact inserted into the receiving region. The clamping sleeve acts on a spring introduced as an additional part into the base body. The spring has a S-shaped profile including a first S-curve section and a second S-curve section. The spring is mounted at one of its end sections on the base body. The spring thus forms a one-sided lever having a short arm between the end section and the first S-curve section and a long arm between the S-curve sections. The short lever arm of the spring bears against a plug contact inserted into the receiving region while the clamping sleeve is in the closed sliding position. The long lever arm of the spring bears against a bulge in the clamping sleeve while the clamping sleeve is in the closed sliding position.

In embodiments of the present invention, the clamping sleeve acts on a spring that is introduced as an added component into the base body. The spring has an S-shaped profile and is mounted at one of its end sections to the base body, thereby forming a single sided lever with a short lever arm between the end section and a first S-curve section of the spring and a comparatively long lever arm from the end section up to a second S-curve section of the spring. The short lever arm is arranged against a plug contact inserted into the receiving region of the sleeve contact when the clamping sleeve is in the closed sliding position. The long lever arm is pressed by a bulge of the clamping sleeve radially inward towards the receiving region of the sleeve contact when the clamping sleeve is in the closed sliding position.

In embodiments of the present invention, a spring for producing the contact force is formed as a separate component. The spring can have properties optimized for producing the contact force since the spring is fabricated separately from the base body. The spring has an S-shaped profile and is mounted to the base body with one of its end sections as a single-sided lever. The spring can exert a large contact force on a plug contact inserted into the receiving region of the sleeve contact due to the leverage effect. Such leverage effect produces an advantageous electrical connection and mechanical attachment of a plug contact inserted into the receiving region of the sleeve contact.

In an embodiment of the present invention, the spring is fabricated simply and cost effectively as a simple S-shaped bent metal strip.

In an embodiment of the present invention, the spring is made from a different material than the base body. For instance, the spring is made from a spring steel material and the base body is made of a different material. In an embodiment of the present invention, the spring is fabricated from a stainless steel, which achieves high corrosion resistance and with it durable electrical contact properties.

In an embodiment of the present invention, the spring has a greater material strength than the base body. The spring can thus have a large spring constant, which allows a relatively high spring force to be produced by a small deflection of the spring.

The above features, and other features and advantages of the present invention are readily apparent from the following detailed description thereof when taken in connection with the accompanying drawings.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 3:
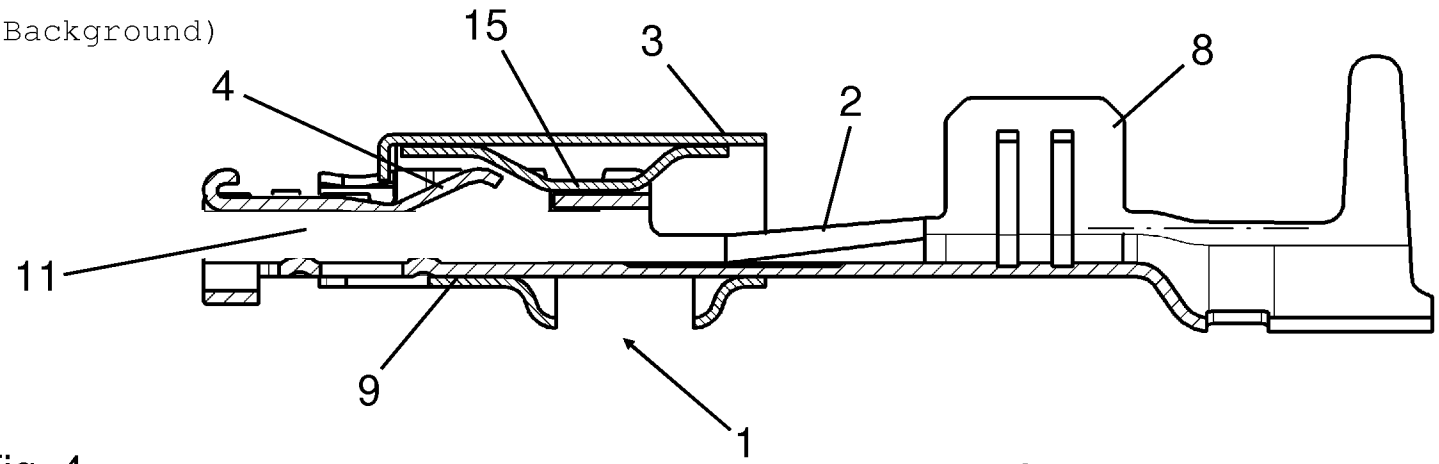
FIG. 3 illustrates a conventional sleeve contact arranged in the opened position for receiving a plug contact.
Figure 4:
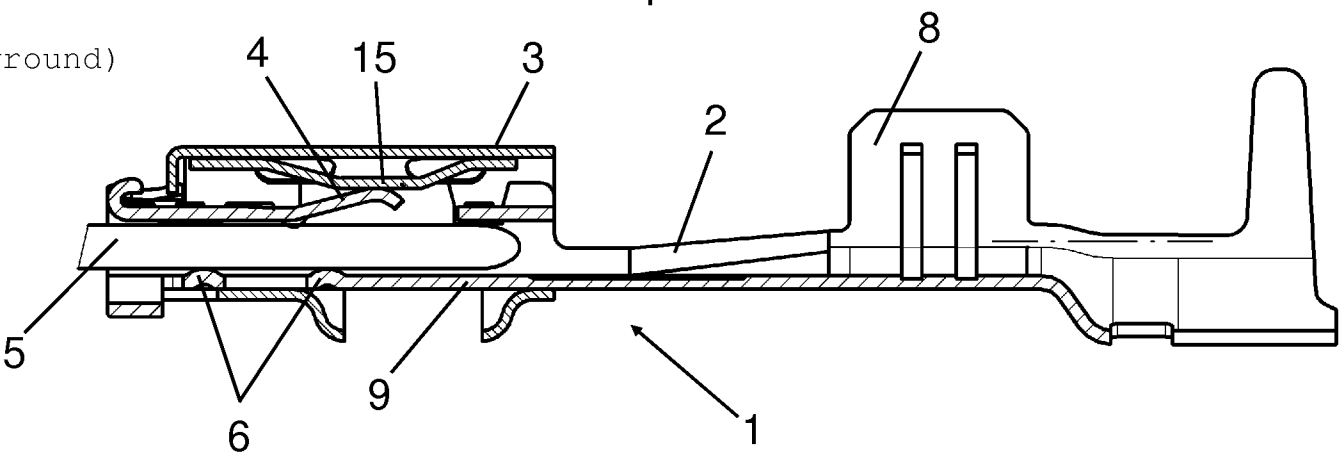
FIG. 4 illustrates the conventional sleeve contact shown in FIG. 3 arranged in the closed position for securely contacting a plug contact inserted into the sleeve contact.

Referring initially to FIGS. 3 and 4, a sleeve contact 1 according to conventional art is shown respectively in two different states of assembly. In particular, in FIG. 3, sleeve contact 1 is arranged in an opened position for receiving a plug contact 5. In FIG. 4, sleeve contact 1 is arranged in a closed position for securely contacting a plug contact 5 inserted into the sleeve contact.

Sleeve contact 1 includes a base body 2 and a clamping sleeve 3. Base body 2 is formed from metal. Base body 2 can be mechanically and electrically connected to an integrally molded crimping section 8 with a connector line (not shown). Base body 2 includes a contact lamination 4 on an input side section of sleeve contact 1. Contact lamination 4 is integrally molded to base body 2. Base body 2 on the input side section of sleeve contact forms a receiving region 11 for receiving a plug contact 5. Base body 2 includes a base plate 9. Contact lamination 4 and base plate 9 together define the boundary of plug contact receiving region 11. Base plate 9 includes a plurality of projecting contact points 6. Contact points 6 extend from base plate 9 radially inwards into receiving region 11. Contact points 6 thereby provide well defined connection points.

Clamping sleeve 3 partially surrounds the circumference of base body 2. Clamping sleeve 3 is arranged so that it slides on base body 2. Clamping sleeve 3 can slide relative to base body 2 between the opened sliding position (shown in FIG. 3) and the closed sliding position (shown in FIG. 4). Clamping sleeve 3 includes a bulge 15. As shown in FIG. 4, when plug contact 5 is in receiving region 11 of sleeve contact 1 and is thereby in the region of contact lamination 4 and contact sleeve 3 is in the closed sliding position, clamping sleeve bulge 15 presses contact lamination 4 in the direction of the plug contact. On the other hand, as shown in FIG. 3, when clamping sleeve 3 is in the opened sliding position and thereby is moved away from contact lamination 4, the clamping sleeve does not apply force to the contact lamination. The latter arrangement of clamping sleeve 3 on base body 2 thereby enables plug contact 5 (shown as a flat connector pin) to be inserted in a force-free manner into receiving region 11 between contact lamination 4 and base plate 9.

Figure 1:
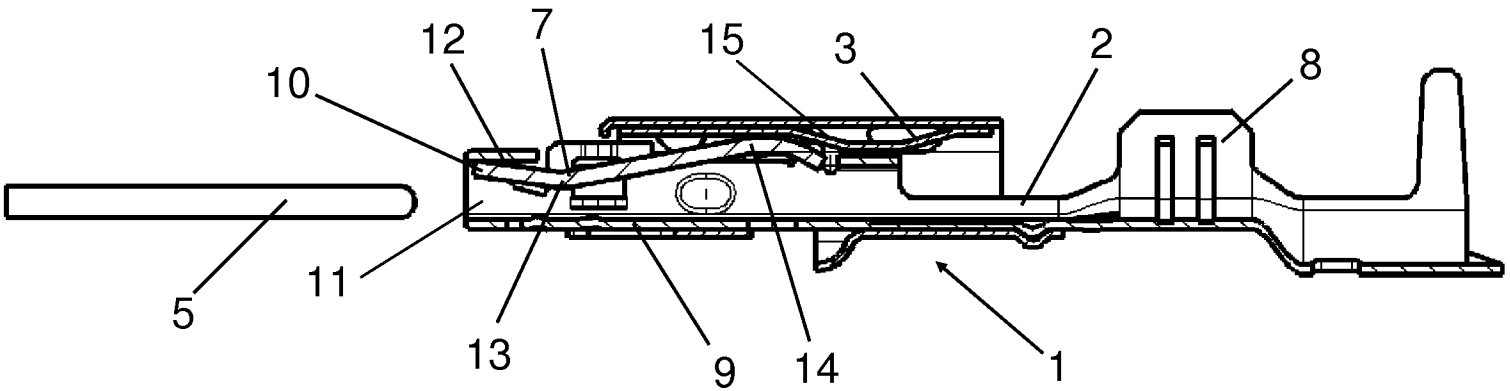
FIG. 1 illustrates a sleeve contact in accordance with an embodiment of the present invention in which the sleeve contact is arranged in an opened position for receiving a plug contact.
Figure 2:
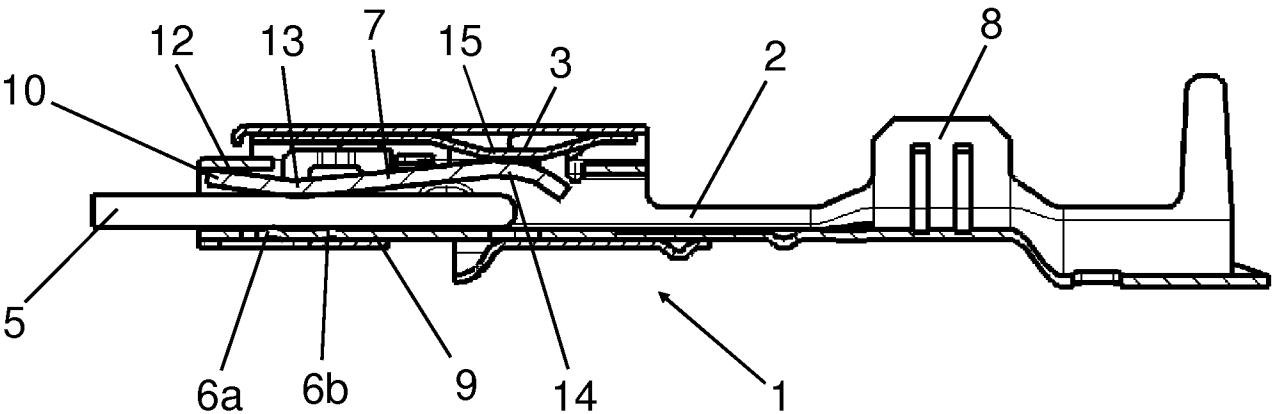
FIG. 2 illustrates the sleeve contact shown in FIG. 1 in which the sleeve contact is arranged in a closed position for securely contacting a plug contact inserted into the sleeve contact.

Referring now to FIGS. 1 and 2, with continual reference to FIGS. 3 and 4, a sleeve contact 1 in accordance with an embodiment of the present invention is shown. In FIG. 1, sleeve contact 1 is arranged in the opened position for receiving a plug contact 5. In FIG. 2, sleeve contact 1 is arranged in the closed position for securely contacting a plug contact 5 inserted into the sleeve contact. Sleeve contact 1 includes certain similar features as conventional sleeve contact 1 and the similar or functionally equivalent features have thus been assigned the same reference symbols.

In contrast to the previously described conventional sleeve contact, sleeve contact 1 shown in FIGS. 1 and 2 has single component sleeve contacts formed as an S-shaped spring 7 instead of integrally formed contact lamination 4. An end section 10 of spring 7 is movably mounted on a bearing point 12 inside base body 2. Spring 7 forms a first S-curve section 13 and a second S-curve section 14. The convex side of first S-curve section 13 extends in the direction of receiving region 11 of sleeve contact 1. Second S-curve section 14 contacts clamping sleeve 3.

Again, clamping sleeve 3 partially surrounds the circumference of base body and the clamping sleeve can slide relative to base body 2 between the opened sliding position (shown in FIG. 1) and the closed sliding position (shown in FIG. 1). When clamping sleeve 3 is displaced to the closed sliding position after the insertion of a plug contact 5 into receiving region 11, bulge 15 of the clamping sleeve 3 finally encounters second S-curve section 14 of spring 7. This causes the free section of spring 7 (i.e., the section of the spring between first and second S-curve sections 13, 14) to be displaced radially inward in the direction of receiving region 11. At the same time, first S-curve section 13 of spring 7 is pressed against plug contact 5.

Since spring 7 is mounted only at its end section 10 on base body 2, the spring forms a one-sided lever having a relatively short lever arm between end section 10 and first S-curve section 13 and a relatively long lever arm from end section 10 up to second S-curve section 14. The short lever arm of spring 7 contacts plug contact 5 inserted into receiving region 11 while clamping sleeve 3 is in the closed sliding position. The long lever arm of spring 7 contacts with clamping sleeve bulge 15 while clamping sleeve 3 is in the closed sliding position.

Spring 7 can exert a large contact force on the inserted plug contact 5 due to the leverage effect, which advantageously produces a good electrical connection and enables an especially good mechanical attachment of a plug contact 5 inserted inside sleeve contact 1. This effect is beneficial because spring 7 is fabricated as a separate piece from base body 2 and can thus have a greater material strength, and can be of a particularly well suited spring material. In particular, spring 7 can be fabricated from a spring steel having a much larger spring constant than contact lamination 4 integrally formed with the base body of conventional sleeve contact 1 shown in FIGS. 3 and 4.

Figure 5:
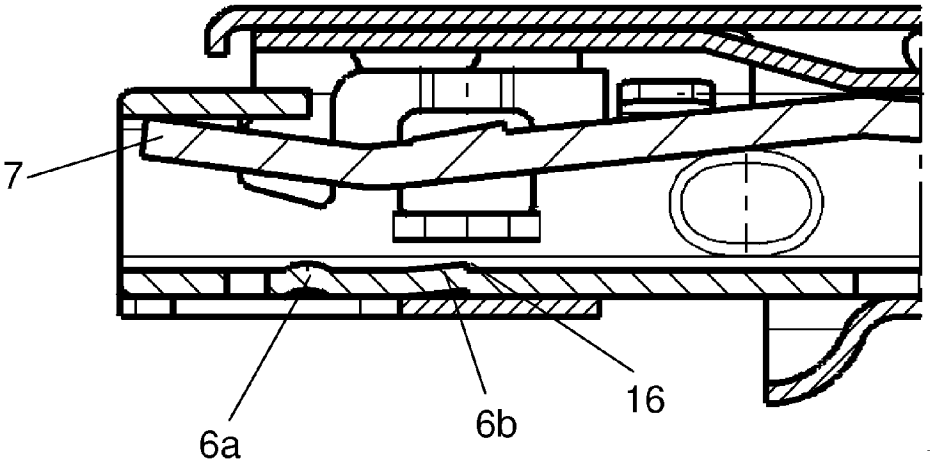
FIG. 5 illustrates an enlarged section view of the sleeve contact shown in FIG. 1 in which the sleeve contact is arranged in the opened position for receiving a plug contact.
Figure 6:
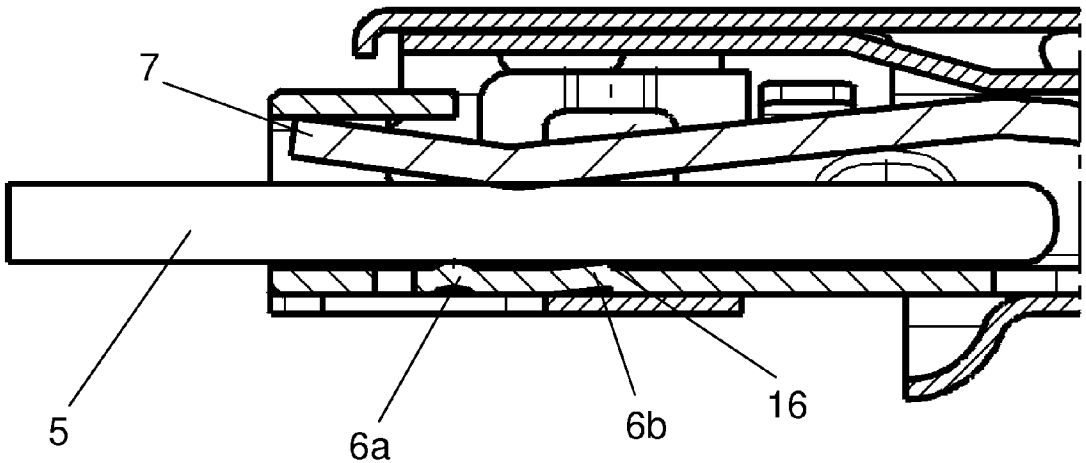
FIG. 6 illustrates an enlarged section view of the sleeve contact shown in FIG. 1 in which the sleeve contact is arranged in the closed position for securely contacting a plug contact inserted into the sleeve contact.

Referring now to FIGS. 5 and 6, enlarged section views of sleeve contact 1 in accordance with an embodiment of the present invention shown in FIGS. 1 and 2 are respectively shown. Sleeve contact 1 is arranged in the opened position in FIG. 5 and is arranged in the closed position in FIG. 6. The enlarged section views of FIGS. 5 and 6 show an especially advantageous arrangement of contact points 6*a*, 6*b* of base plate 9 of base body 2.

Similarly to conventional sleeve contact 1 shown in FIGS. 3 and 4, sleeve contact 1 in accordance with the illustrated embodiment of the present invention shown in FIGS. 1 and 2 has a plurality of contact points integrally molded on its base plate 9. These contact points, indicated as two sequentially arranged points of contact 6*a*, 6*b*, create a stable support for a contact plug 5 inserted into the receiving region 11 of the sleeve contact and simultaneously form well-defined electrical contact points.

In contrast to the two identical contact points 6 that are formed as cap-shaped protrusions of conventional sleeve contact 1, contact points 6*a*, 6*b* of the illustrated embodiment of contact sleeve 1 shown in FIGS. 1, 2, 5, and 6 are designed differently. First contact point 6*a* is formed as a conventionally designed contact cap. Second contact point 6*b* is formed as a slanted plane, which forms a sharply falling edge 16 at its end. Sharp edge 16, supported by the lever action of spring 7 that acts above the two contact points 6*a*, 6*b* on contact plug 5, presses a piece far into the material of the contact plug and thus stabilizes the contact plug inside receiving region 11 of sleeve contact 1. This significantly reduces a sidewise displacement, rotation, or removal of contact plug 5 from sleeve contact 1 by sharp edged contact point 6*b*.

REFERENCE SYMBOLS

1 sleeve contact
2 base body
3 clamping sleeve
4 base body contact lamination
5 plug contact (plug pin)
6, 6*a*, 6*b* base plate contact points
7 spring
8 crimping section of the base body
9 base plate of the base body
10 end section of the spring
11 plug contact receiving region (of the sleeve contact)
12 bearing point
13 first S-curve section of the spring
14 second S-curve section of the spring
15 contact sleeve bulge
16 contact point edge While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A sleeve contact comprising:

a base body having a receiving region;

a clamping sleeve displaceable against the base body; and a spring having first and second S-curve sections and being mounted at one end to the base body to thereby form a lever having a short lever arm from the end to the first S-curve section and a long lever arm from the end to the second S-curve section;

wherein the clamping sleeve acts on the spring as the contact sleeve displaces to produce a contact force towards the receiving region such that the long lever arm is pressed by the clamping sleeve towards the receiving region to thereby cause the short lever arm to bear against a plug contact inserted into the receiving region.

2. The sleeve contact of claim 1 wherein:

the spring has a greater material strength than the base body.

3. The sleeve contact of claim 1 wherein:

the spring is of a different material than the base body.

4. The sleeve contact of claim 3 wherein:
the spring is a steel spring.

5. The sleeve contact of claim 1 wherein:
the base body is integrally formed as a single piece.

6. The sleeve contact of claim 1 wherein:
the clamping sleeve is spring loaded.

7. The sleeve contact of claim 1 wherein:
the base body includes a base plate having a plurality of contact points protruding into the receiving region in which at least one the contact points is formed with a sharp edge.

8. A sleeve contact for an electrical zero force plug type connector, the sleeve contact comprising:

a base body having a receiving region to receive a plug contact therein;

a clamping sleeve having a bulge, the clamping sleeve displaceable against the base body between an opened position and a closed position, wherein while in the opened position the clamping sleeve enables a plug contact to be inserted into or removed from the receiving region; and a spring having a S-shaped profile including a first S-curve section and a second S-curve section and being mounted at one end to the base body to thereby form a lever having a short lever arm from the end to the first S-curve section and a long lever arm from the end to the second S-curve section;

wherein the clamping sleeve acts on the spring as the clamping sleeve displaces against the base body between the opened and closed positions, wherein while in the closed position the clamping sleeve produces a contact force towards the receiving region such that the long lever arm is pressed by the bulge of the clamping sleeve radially inwards towards the receiving region to thereby cause the short lever arm to bear against a plug contact inserted into the receiving region in order to securely contact the plug contact inserted into the receiving region.

9. The sleeve contact of claim 8 wherein:
the spring has a greater material strength than the base body.

10. The sleeve contact of claim 8 wherein:
the spring is of a different material than the base body.

11. The sleeve contact of claim 10 wherein:
the spring is a steel spring.

12. The sleeve contact of claim 8 wherein:
the base body is integrally formed as a single piece.

13. The sleeve contact of claim 8 wherein:
the clamping sleeve is spring loaded.

14. The sleeve contact of claim 1 wherein:
the base body includes a base plate having a plurality of contact points protruding into the receiving region in which at least one the contact points is formed with a sharp edge.

* * * * *